US011566439B2

(12) United States Patent
Schwab

(10) Patent No.: US 11,566,439 B2
(45) Date of Patent: Jan. 31, 2023

(54) BURIAL VAULT

(71) Applicant: Polyguard & Co., LLC, Afton, WY (US)

(72) Inventor: Marvin Lee Schwab, Afton, WY (US)

(73) Assignee: POLYGUARD & CO., LLC, Afton, WY (US)

( * ) Notice: Subject to any disclaimer, the term of this patent is extended or adjusted under 35 U.S.C. 154(b) by 265 days.

(21) Appl. No.: 16/832,351

(22) Filed: Mar. 27, 2020

(65) Prior Publication Data

US 2020/0340265 A1 Oct. 29, 2020

Related U.S. Application Data

(60) Provisional application No. 62/837,329, filed on Apr. 23, 2019.

(51) Int. Cl.
*E04H 13/00* (2006.01)
*A61G 17/00* (2006.01)

(52) U.S. Cl.
CPC ..... *E04H 13/00* (2013.01); *E04H 13/005* (2013.01); *A61G 17/00* (2013.01); *E04H 13/003* (2013.01)

(58) Field of Classification Search
CPC ..... E04H 13/00; E04H 13/005; E04H 13/003; A61G 17/00; A61G 17/02
See application file for complete search history.

(56) References Cited

U.S. PATENT DOCUMENTS 1,953,374 A * 4/1934 Todhunter ..... A61G 17/0106 27/35
5,746,030 A * 5/1998 Sannipoli, Sr. ..... E04H 13/00 52/136
6,018,853 A * 2/2000 Chen ..... A61G 17/004 27/4
6,497,018 B1 * 12/2002 Chiu ..... A61G 17/004 220/4.28
8,689,992 B2 * 4/2014 Anderson ..... A47C 7/628 220/4.31
2010/0242379 A1 * 9/2010 Norder ..... E04H 13/00 52/742.14

* cited by examiner

*Primary Examiner* — Brian D Mattei
*Assistant Examiner* — Omar F Hijaz
(74) *Attorney, Agent, or Firm* — Andrew F. Young; Nolte Lackenbach Siegel

(57) ABSTRACT

A burial vault system and burial vault kit arrangement include a first pair of lateral sides; a second pair of lateral sides; a base having a length and a width configured to releasably receive the first pair of lateral sides at opposing ends of the length and configured to releasably receive the second pair of lateral sides at opposing ends of the width; the second pair of lateral sides each defining an inner surface, the inner surface defining at least one channel extending partially along respective heights of the lateral sides; and at least one adjustable crossbar configured received within the channel to span to brace the second pair of lateral sides to resist compression and support a casket each crossbar including at least one end cap adjustably received on an end to allow a length adjustment. A method of assembly is also disclosed. A kit assembly of the burial vault is presented.

4 Claims, 9 Drawing Sheets

BURIAL VAULT

CROSS REFERENCE TO RELATED APPLICATIONS

This application relates to, and claims priority from U.S. Prov. Ser. No. 62/837,329 filed Apr. 23, 2019, the entire contents of which are fully incorporated herein by reference.

FIGURE SELECTED FOR PUBLICATION

FIG. 4.

BACKGROUND OF THE INVENTION

Field of the Invention

The present invention generally relates to a burial vault, and more particularly to a burial vault system and burial vault kit that can be stored in a flat-pack ready-to-assemble form and which can be readily assembled for use.

Description of the Related Art

Land for new cemeteries is expensive. There is also the issue of people being unable to be buried with other family members because there is no space. One solution to the limited space in cemeteries is to bury a first coffin at a first depth and a second coffin above the first coffin at a second depth that is less than the first depth. Thus, increasingly, a gravesite that might have traditionally been utilized to accommodate a single interred casket might be reopened to inter another casket at a shallower depth at a later time. For example, a husband and wife may be so buried, in separate coffins stacked one above the other. Given the space constraints, there is an international trend to bury caskets containing deceased at various depths within the ground such that more space within a cemetery can be utilized, thereby accommodating an ever-increasing number of bodies.

Even without considering the limiting space available for interring the deceased in cemeteries, digging a grave is a labor-intensive process. Depending on religious beliefs and other considerations, some people may need or want to bury their departed relatives or friends without any undue delay. It would be desirable that a gravesite may be readied at an earlier time, e.g., years, prior to the death of the individual to be interred. To that end, it would be desirable select a grave, prepare a hole within the grave, and maintain the hole in a condition where the interment of the coffin within the hole requires a minimum of work to place the coffin within the hole of the grave. It is also desirable that once the casket is placed within the grave, the casket is protected from the crushing weight of the earth which might otherwise shift the position of the casket or cause damage to the casket and from damaging chemical interaction with ground water.

Ensuring the suitability of a gravesite to receive caskets involves numerous considerations as preparing a grave involves more than just digging a hole, particularly when the hole is to be used at a later time. The piles of earth that are removed from the gravesite are later backfilled into the hole. Once the grave is backfilled with loose soil, the walls defining the hole may apply pressure to the loose soil and collapse into the area that was filled with the loose soil. Accordingly, the land beneath the surface of the grave may shift position. When attempting to position gravesites near one another and also when attempting to stack caskets vertically in a single gravesite having a length and width that is appropriate for a single casket, it would be desirable that long after burying a first casket that the casket remains in roughly the same position where it had been buried.

In the past, to accommodate some of these concerns, a separate container called a burial vault was used to contain an individual coffin. Currently such burial vaults are made of rigid concrete, which is extremely heavy, difficult to store and handle, and expensive to ship and use. There are no multiple-depth concrete burial vaults. Thus, a first empty burial vault may be placed in a grave prior to the placement of a casket within the burial vault such that a hole that had been previously dug need not be re-dug when later burying. This allows the concrete burial vault to fill the void of the grave and retain the integrity of the hole within the earth until a single coffin can be used. When needed, the earth is dug up, the top of the concrete burial vault lifted by a hydraulic crane, the coffin positioned, and the concrete top lowed back in position. To accomplish this goal, the vaults need to be sufficiently structurally strong to support the weight of soil that is backfilled into the grave such that the vault supports the crushing weight of the soil.

If a grave site needs to have two coffins in two concrete burial vaults there is great difficulty in pre-use-arranging, accessing one burial vault at a time for different uses, and repositioning concrete burial vaults.

It will be understood by those of skill in the art that pre-formed concrete burial vaults include a rigid bottom form and a rigid top form, which must be pre-made and stored before need. This requires a great deal of underutilized space, the use of hydraulic lifting systems or machines, and this prevents the convenient use of shipping trucks and fork-trucks commonly in use with commercial shipping carriers such as DHK, UPS, FedEx, etc.

The present invention attempts to address at least one, and preferably more than one, of the concerns noted herein above.

ASPECTS AND SUMMARY OF THE INVENTION

In an embodiment, a burial vault may include an interior space configured to receive a single casket.

In another embodiment, a burial vault may include an interior space configured to receive a plurality of caskets, spaced apart. For example, the burial vault may include an inner height sufficient to accommodate two caskets that are arranged vertically at a first depth and at a second depth.

In another alternative embodiment, a burial vault may include: a first pair of lateral sides; a second pair of lateral sides; a base having a length and a width configured to releasably receive the first pair of lateral sides at opposing ends of the length and configured to releasably receive the second pair of lateral sides at opposing ends of the width; the second pair of lateral sides each defining an inner surface, the inner surface defining a plurality of rigidizing structures extending partially along respective heights of the lateral sides; and a top cover joining the respective pairs of lateral sides. A plurality of self-contained and concealed fasteners is provided so that the respective sides and bottom may be securely joined together in a sealing manner. One or more water-proof gaskets are provided along the bottom and top rims and respective side edges so as to provide a water-proof burial vault that may be easily flat-packed, and be easily assembled by a single worker.

In another alternative embodiment, a burial vault may include: a first pair of lateral sides; a second pair of lateral sides; a base having a length and a width configured to releasably receive the first pair of lateral sides at opposing ends of the length and configured to releasably receive the second pair of lateral sides at opposing ends of the width; the second pair of lateral sides each defining an inner surface, the inner surfaces defining a plurality of extending rigidizing structures to prevent unintended flexing, and along two opposing sides defining opposed channels extending partially along respective heights of the lateral sides; a plurality of lateral crossbars with lateral ends receivable within the opposed channels and configured to span the width and to support an optional shelf and to brace the second pair of lateral sides to resist bending forces applied to an exterior surface of the second pair of lateral sides.

A method of assembling a burial vault may include: providing a burial vault, comprising: a first pair of lateral sides; a second pair of lateral sides; a base having a length and a width configured to releasably receive the first pair of lateral sides at opposing ends of the length and configured to releasably receive the second pair of lateral sides at opposing ends of the width; the second pair of lateral sides each defining an inner surface, the inner surface defining at least one channel extending partially along respective heights of the lateral sides; and at least one crossbar configured to be received within the channel and configured to span the width and to brace the second pair of lateral sides to resist forces applied to an exterior surface of the second pair of lateral sides, each crossbar including at least one end cap threadably received on an end of the crossbar such that an overall length of the crossbar is adjustable by rotation of one or more of the ends along an adjustment; securing the first pair of lateral sides at opposing ends of the length of the base; securing the second pair of lateral sides at opposing ends of the width of the base; securing the at least one crossbar within opposing ones of the channels of the second pair of lateral sides and tensioning the at least one crossbar to span a space between the second pair of lateral sides. It is an aspect of the present invention that the crossbars may be removed when there is substantial crushing force from the external sides (outside) via earth subsiding.

The above and other aspects features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
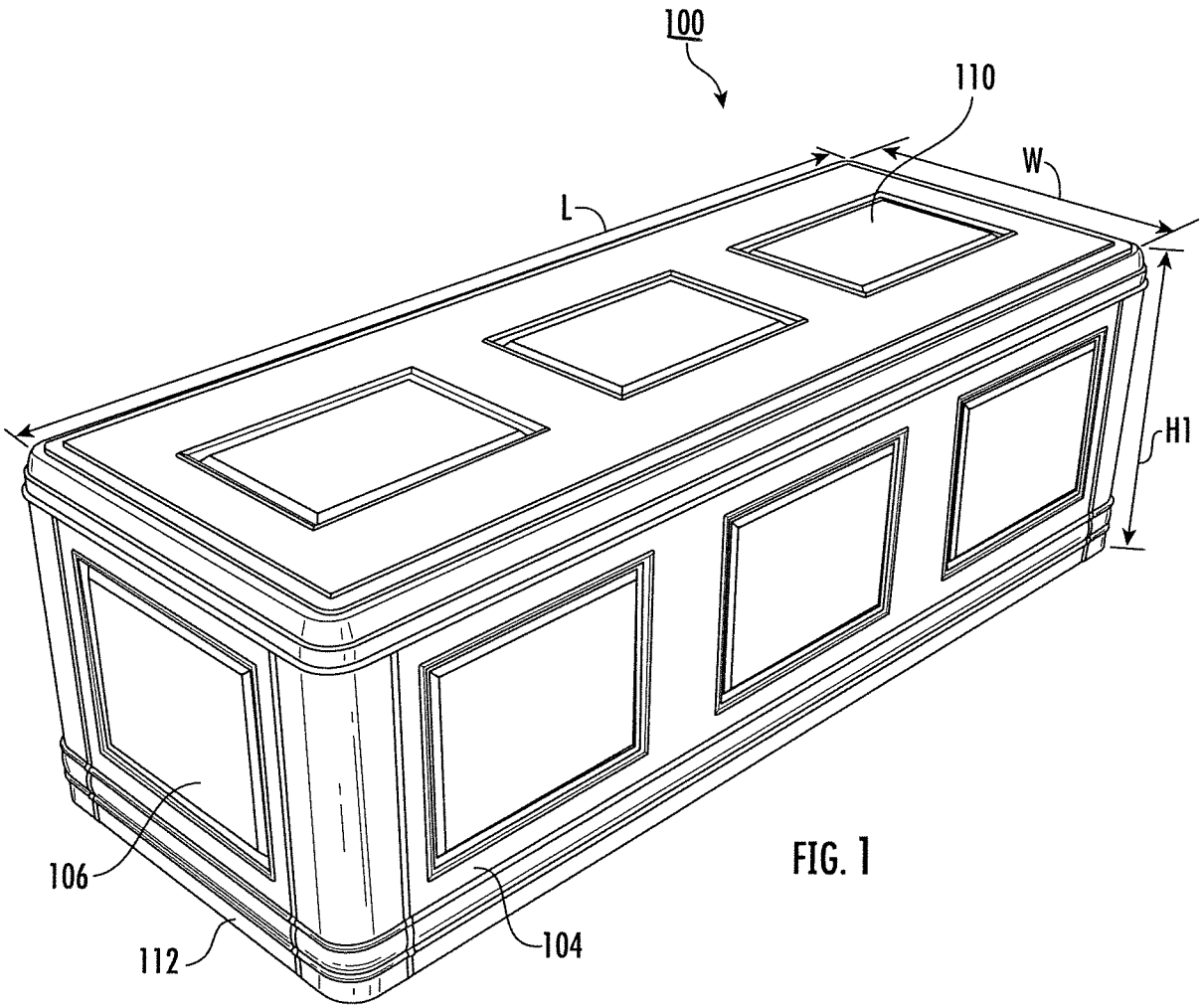
FIG. 1 is a perspective view of a single capacity burial vault in accordance with the present disclosure.

Reference will now be made in detail to embodiments of the invention. Wherever possible, same or similar reference numerals are used in the drawings and the description to refer to the same or like parts or steps. The drawings are in simplified form and are not to precise scale. The words 'couple' or 'join' or 'secure' and similar terms do not necessarily denote direct and immediate connections, but also include connections through intermediate elements or devices. For purposes of convenience and clarity only, directional (up/down, etc.) or position (top/bottom/side) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Figure 2:
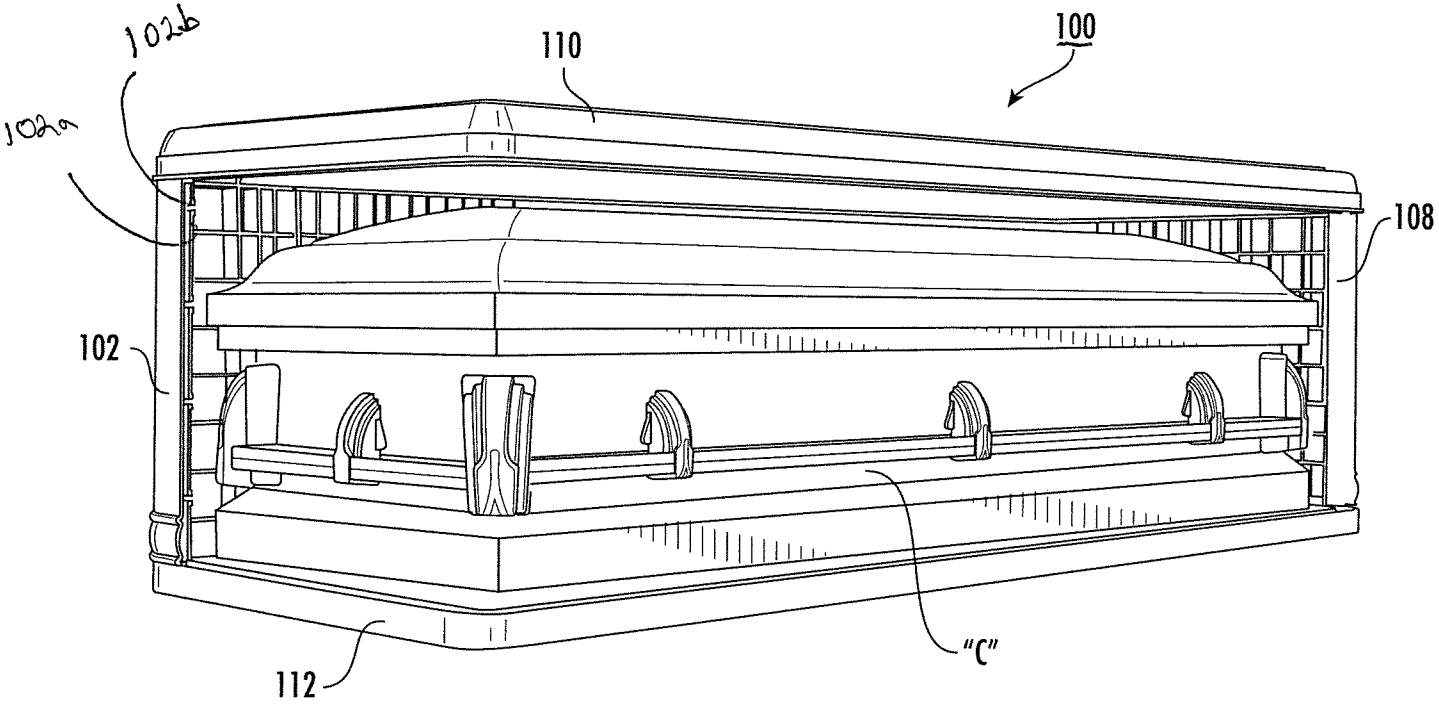
FIG. 2 is a perspective cut-away view of the single capacity burial vault of FIG. 1 with two lateral walls removed and showing an interior containing a casket.
Figure 3:
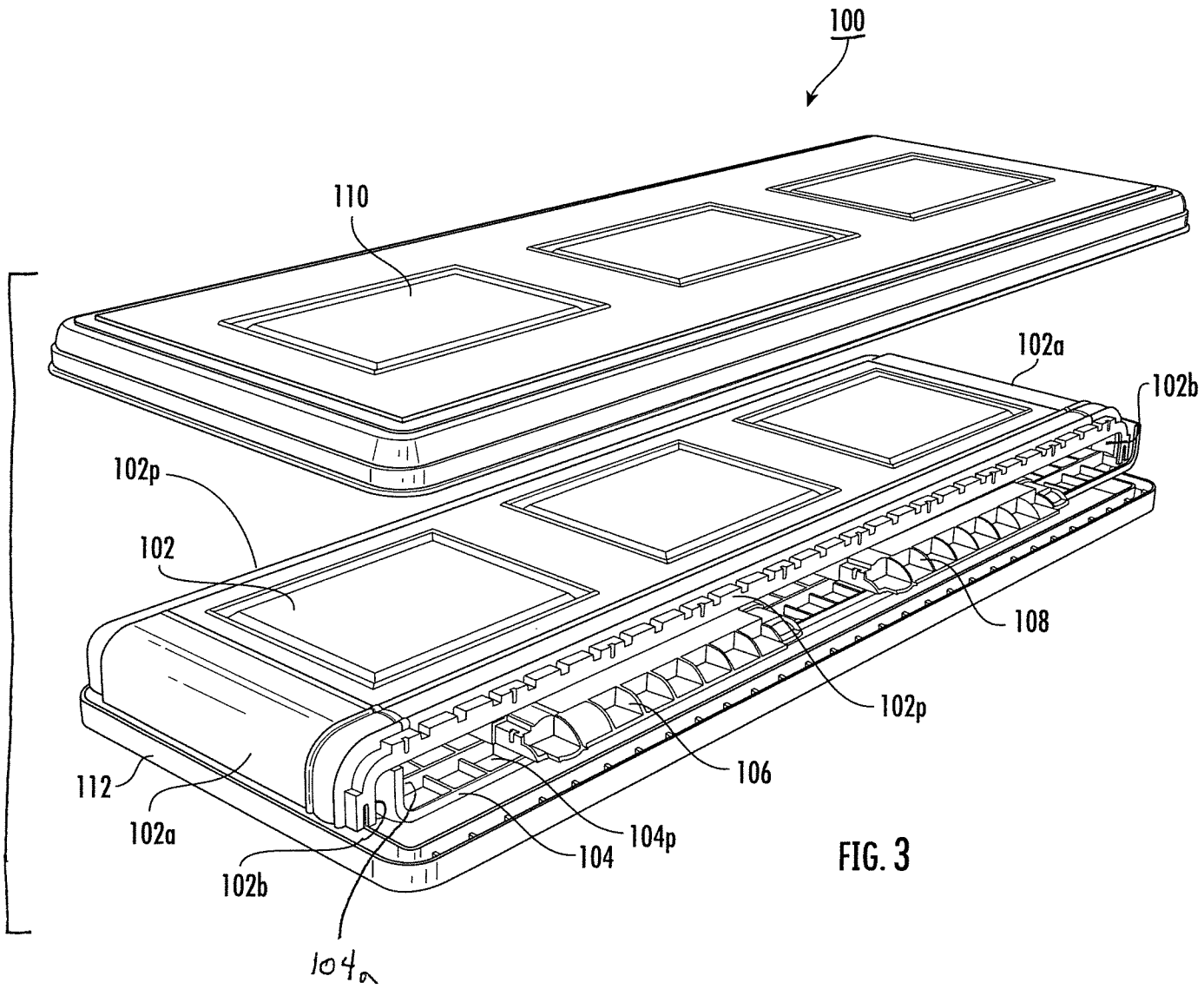
FIG. 3 is a perspective view illustrating the single capacity burial vault of FIG. 1 shown in a collapsed, flat-pack or kit form.

A single capacity burial vault 100 is described herein with reference to FIGS. 1-4, as well as a flat pack kit form as shown in FIG. 3 allowing ready storage, transportation, and assembly for use.

The single capacity burial vault 100 may be in any convenient form but is shown having a generally rectangular shape and may include six segments or sides, including long lateral sides 102, 104 and shorter lateral sides 106 and 108, a cover or lid 110, and a base 112, that may be assembled by securing the segments to one another to define the rectangular shape.

Figures 4, 4A:
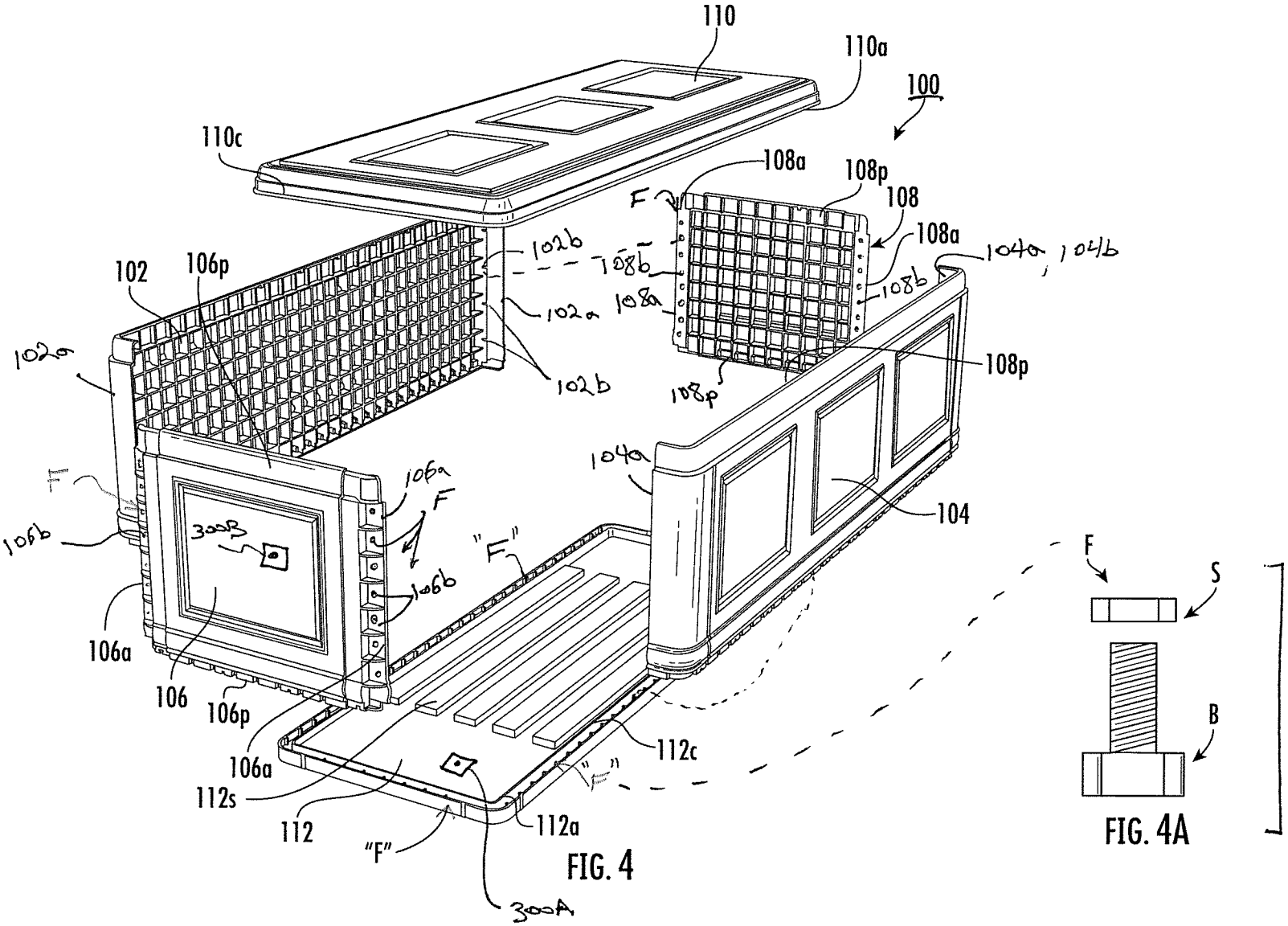
FIG. 4 is an exploded perspective view of the single capacity burial vault of FIG. 1 shown with parts exploded.
FIG. 4A is a front view of a concealed fastener including a bolt and a washer used for joining sides together and floor and sides together during an assembly step.

When assembled, as shown in FIGS. 1, 2, and 4, the burial vault 100 may have a length L and a height H1 sufficient to accommodate a casket (FIG. 2) during a use within an interior space defined by and bounded by the burial vault 100. At opposing lateral sides of the length of the burial vault 100, the burial vault 100 includes a first long lateral side 102 and a second long lateral side 104. Each of the first lateral side 102 and the second lateral side 104 have length L and height H1. At the foot of the burial vault 100 and coupling the first lateral side 102 to the second lateral side 104 is a lateral side 106. At the head of the burial vault 100 and coupling the first long lateral side 102 to the second long lateral side 104 is a short lateral side 108.

The base 112 couples the four respective lateral sides, namely sides 102, 104, 106, and 108, and has a length L and a width W. The base 112 may optionally include grooves 112*s* spanning substantially its whole length L such that straps that are used to lower a casket C into the interior space of the vault 100 may be received upon the supports 112*s* when the casket C is fully placed upon the base 112 and spaced from a surface of base 112 such that when so placed, support straps (not shown, but supporting a casket C) will not be compressed in place but can be retrieved without disturbing the placement of the casket C within the vault 100 after its placement on the upper surface of the base 112. It will be recognized that supports 112*s* are shown in a convenient faun for manufacture, but may be in any form suitable for removal of casket-lifting-straps.

The cover 110 has roughly the same dimensions as the base 112 and may have one or more decorative indicia thereon (shown with three impressed panels), and also couples the four lateral sides 102, 104, 106, and 108 and may include a sealing gasket within an upper groove (not shown). The sides 102, 104, 106, 108, 110, 112 may include mating flange parts such that the sides may be coupled to one another, using fasteners F as will be discussed. It will be understood that the mating flange parts (to be discussed) are shown in one embodiment, but will be understood by those of skill in this art having studied the disclosure as being capable of existing in other forms and shapes adapted for the needs and aspects of the present invention. Herein, the use of captive bolts and slide-in-grooves (to be discussed) provides a convenient manner for hand-assembly without undue post-delivery manufacture or effort.

When all of the sides 102, 104, 106, 108, 110, and 112 are assembled, no fasteners F are shown, the burial vault 100 may be substantially or completely sealed, with or without a gasket within one or more receiving gasket grooves, or otherwise sealed, and thereby impervious to the penetration of air or liquid into the interior space defined within the burial vault 100 in which the casket C is to be placed. The cover 110 may be releasable or removable from the burial vault 100 such that the interior space may be accessed.

As noted in FIG. 4, one or more one-way valves may be provided to accommodate decomposition events, moisture seepage, or gas generation. An exemplary one-way moisture valve 300A is shown on base or bottom wall 112 (FIG. 4) and an exemplary one-way gas valve 300B is shown on one of the lateral walls (106 shown) in FIG. 4. In this manner the present invention can accommodate the results of pre-positioning-before-use the burial vault, and then accessing the same years later for actual use by a coffin C, whereby the burial vault is maintained in a dry condition and at a neutral gas-pressure over long periods of time.

Advantageously, the burial vault 100 may be stored in a flat-pack kit-form, as shown in FIG. 3, which may be easily shipped and easily stored. As shown in FIG. 3, the sides 102, 104, 106, 108, 110, and 112 may have complementary shapes such that they may be stacked in a relatively flat form with curvatures interfitting, and with a cover or top 110 and bottom or base 112 providing secure stacking surfaces. It will be understood that fasteners F (see FIG. 4A) and other elements such as lateral support cross bars 214 (see FIGS. 6 and 7). For example, the long lateral sides 102 and 104, when stacked one atop the other may define a space therebetween in which the short sides 106 and 108 may be positioned. The top 110 and the bottom 112 may sandwich the sides 102 and 104 therebetween such that all the sides 102, 104, 106, 108, 110, and 112 may be stored in a relatively flat form and easily sealed with heavy duty shrink wrap.

As shown FIGS. 4 and 4A, the lateral sides 102 and 104 may each define generally planar surfaces that include end surfaces 102*a*, 104*a* that curve inwardly, thereby generally forming a C-shape on either end. The sides 106 and 108 that form the head and the foot of the burial vault 100 may be generally planar and have projecting mating flanges (as shown). The end surfaces 102*a*, 104*a* of the lateral sides 102, 104 may each include an inner projection with a series of receiving grooves 102*b*, 104*b* that can receive threaded ends of fasteners F extending through respective captive holes 106*b*, 108*b* in extending mating part lips 106*a*, 108*a*, or 106*p*, 108*p* of the sides 106 and 108. For example, each of the sides 106 and 108 may include (as shown for interfitting) lips 106*a*, 108*a*, respectively, on opposing lateral sides running along the height H1. The lips 106*a*, 108*a* may each be received within the grooves 102*b*, 104*b* defined on opposing sides of the lateral sides 102, 104. The lateral side 104 may similarly include grooves on opposing sides thereof, along its length L, to receive lips 106*a* and 108*a*, respectively, of the sides 106 and 108 respectively. Each of the sides 102, 104, 106, 108 include protrusions 102*p*, 104*p*, 106*p*, 108*p* respectively, at opposing upper and bottom sides with respect to height H1 that are configured to be received within grooves 110*c*, 112*c* defined along the perimeter 110*a*, 112*a* of the lid 110 and base 112, respectively. Fasteners F are configured to pass through openings 106*b*, 108*b* defined within the sides 106, 108 and be captive therein so that their extended threaded shafts engage correspondingly positioned grooves within the base 112 and/or the cover 110, or respective long lateral sides 102, 104 such that once the sides of the burial vault 100 are secured to one another, they will remain so positioned with respect to one another unless the fasteners F are removed. Top or lid 110 is snug-fit and pressure sealed but may be removed after initial assembly for placement of a casket C, as shown in FIG. 2. Fastener F may include a bolt B and a washer S, with the washer S being threadably received onto the bolt, or in other fastener-configurations effective to achieve the needs of the present invention. It will be understood that a single user may easily assemble this burial vault by positioning base or bottom wall 12, and inserting respective fasteners along the bottom holes so that shafts extend. Then fasteners F are extended through holes 106*b*, 108*b* in respective end walls 106, 108. Then side walls 102, 104, 106, and 106 are interfit together so that the extending threaded shafts of fasteners F are received within corresponding flange grooves (e.g., 102*b*, 104*b*, 106*p*, and at the bottom of each side wall 102, 104, 106, and 108) and tightened.

Figure 5:
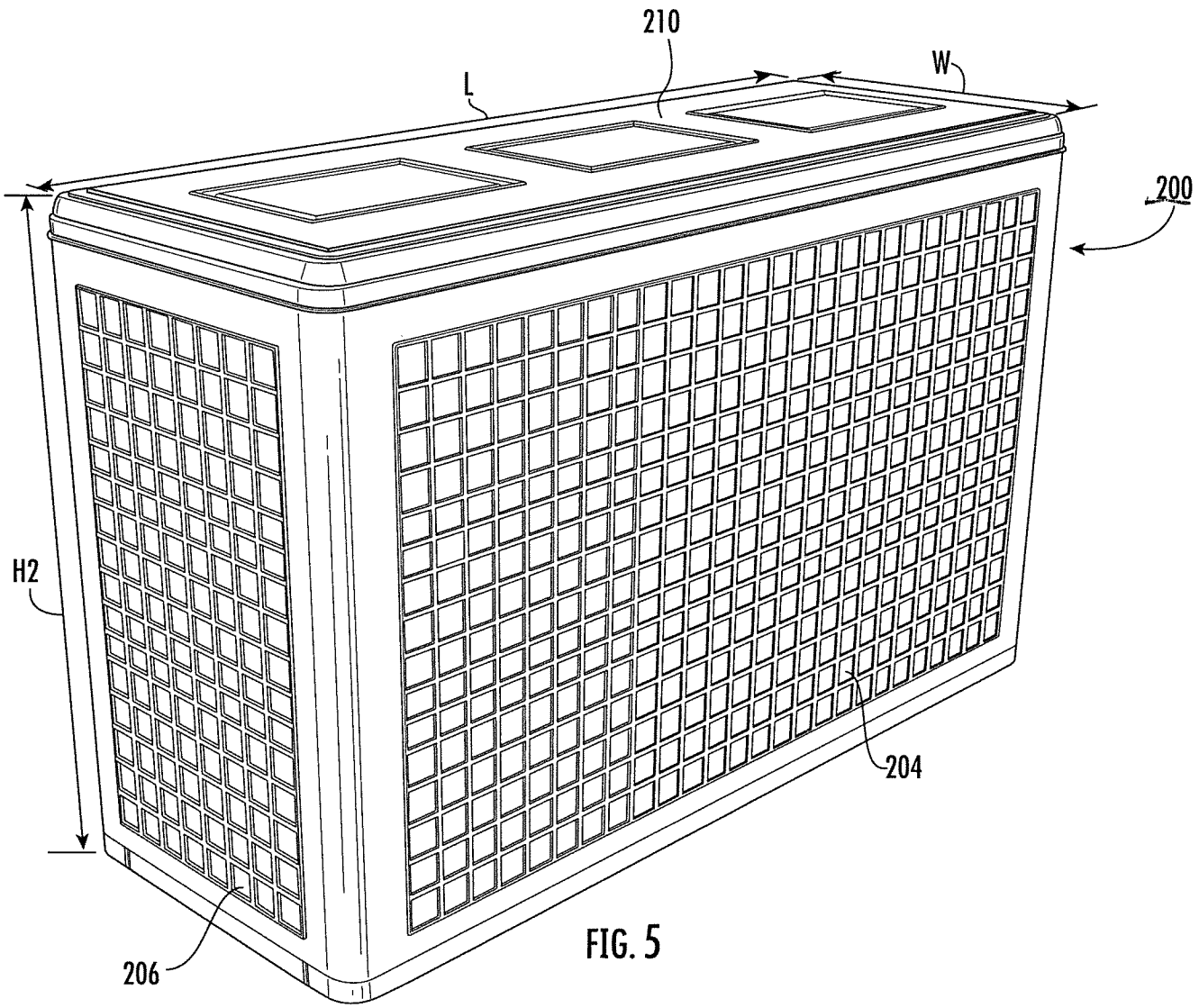
FIG. 5 is a perspective view of a double capacity burial vault in accordance with the present disclosure.
Figure 6:
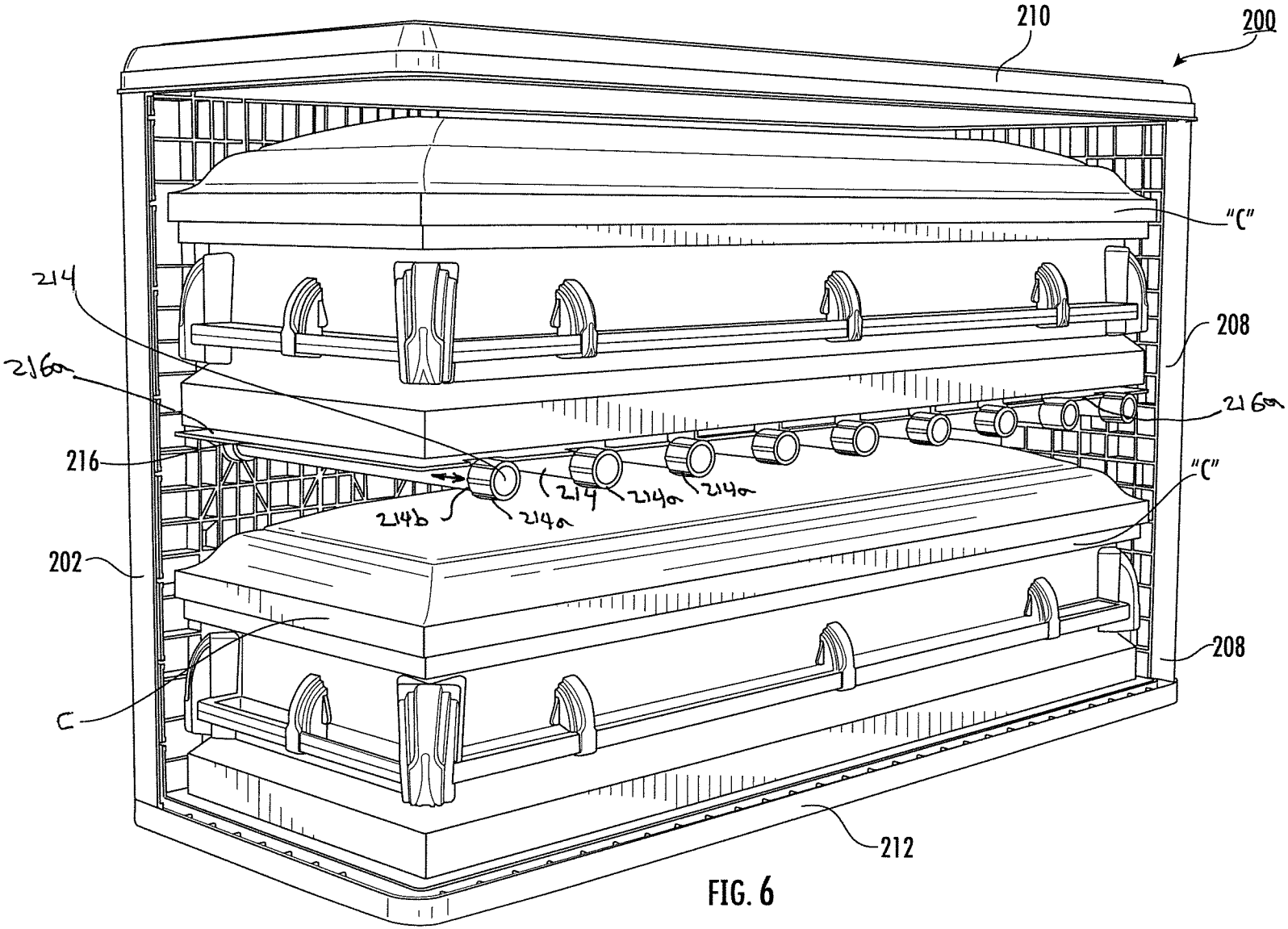
FIG. 6 is a perspective cut-away view of the double capacity burial vault of FIG. 5 with two lateral walls removed and showing an interior containing two caskets supported on lateral support bars retained within a side shelf support channel.

A double capacity burial vault 200 is described with reference to FIGS. 5-9. The double capacity burial vault 200 is substantially similar to the single capacity burial vault 100 except that it is configured to accommodate a plurality of coffins C in a supportive arrangement, and is additionally strengthened to withstand being empty while placed in the ground awaiting future use. As shown in FIG. 6, the double capacity burial vault 200 may contain two coffins C, C one supported over the other. The respective sides 202, 204, 206, 208, and lid or top cover 210, and base or bottom wall 212 correspond to the sides 102, 104, 106, 108, 210, 212, respectively, of the vault 100 except in the ways noted herein. In particular, the height H2 of the vault 200 is greater than the height H1 of the vault 100 as shown in FIG. 5. However, a coffins C typically have standard dimensions, the length L and width W of the vault 200 may be the same as the length L and width W of the vault 100 with the height being different. The base 212 may include supports 212*s* that are substantially similar to the supports 112*s* discussed above with respect to the vault 100 to allow for the removal of support straps used to lower coffins C into position.

To support the weight of the soil that may be applied to the opposing walls or sides 202, 204, along the length L, when the vault 200 is placed within the earth and also to support an upper placed coffin C placed at a shallower depth relative to a lower placed coffin C, the stiffening and rigidizing fool's and structures on the walls (e.g., stiffening geometries) are formed more robustly, as shown. Additionally, for both support of a top casket C, additionally adjustable lateral cross supports or crossbars 214 may span the width W in the interior space of the vault 200.

Figure 7:
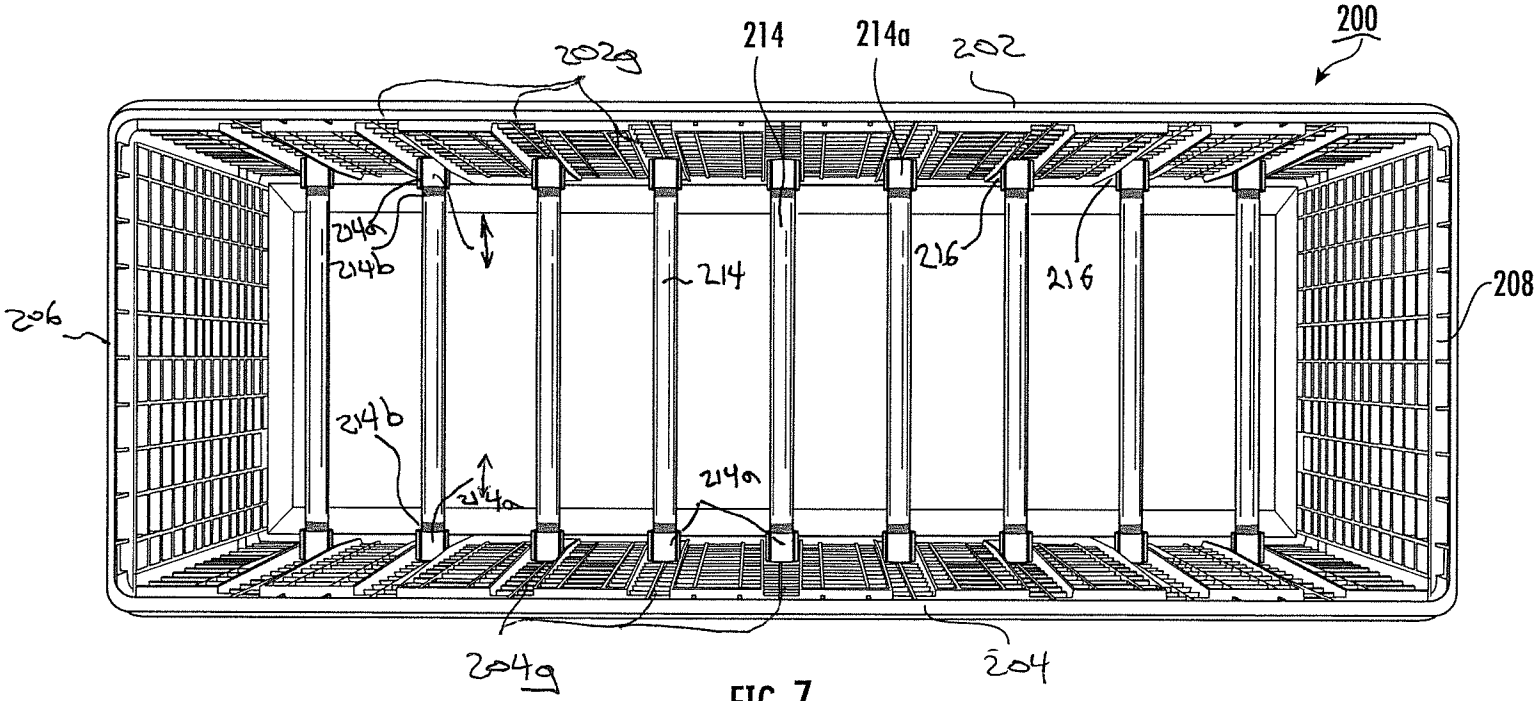
FIG. 7 is a top view of the double capacity burial vault of FIG. 5 with its cover removed and including a single casket within its interior below a row of assembled lateral support bars retained within opposing side shelf support channels.
Figure 8:
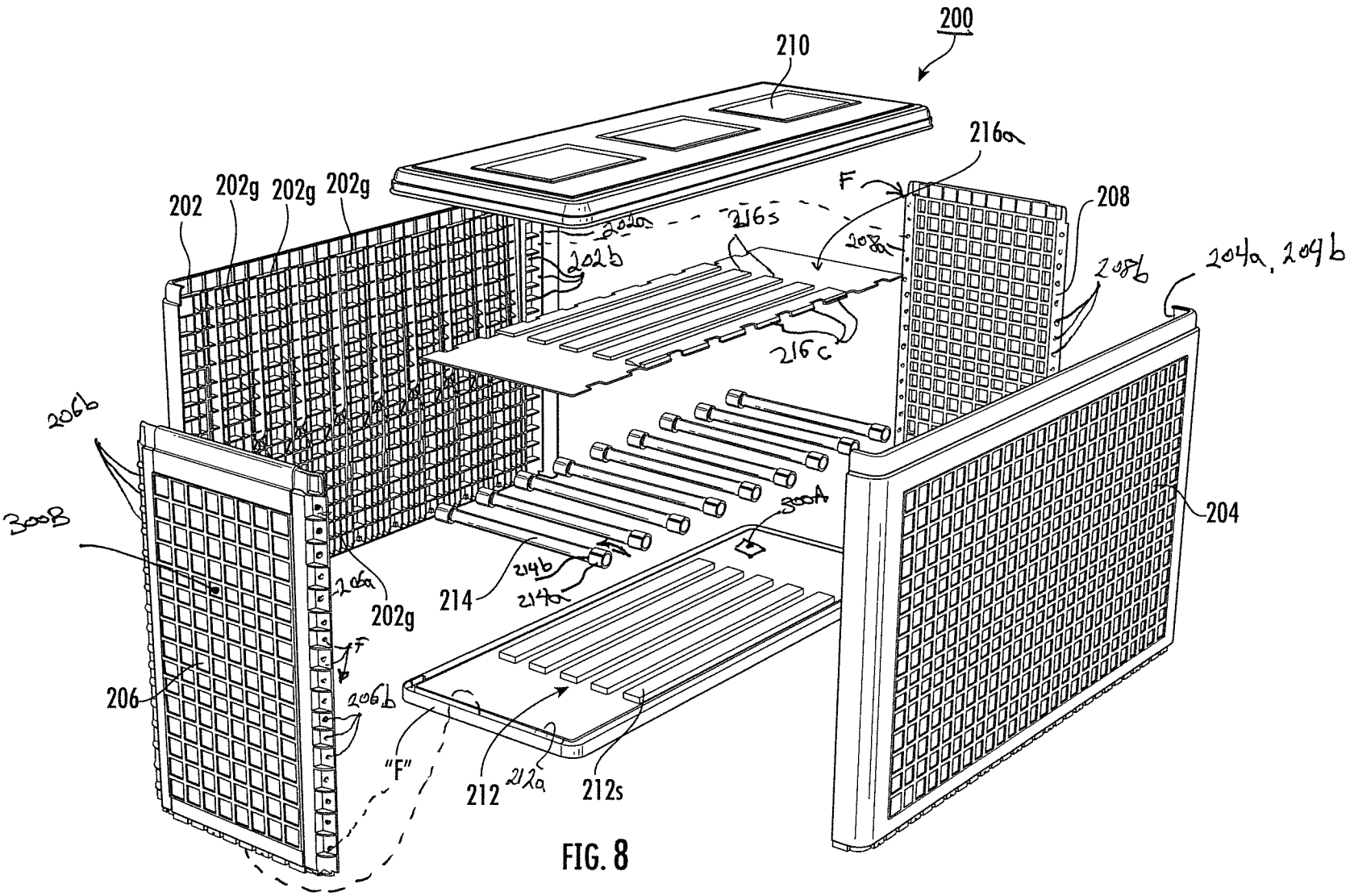
FIG. 8 is an exploded perspective view of the double capacity burial vault of FIG. 5 noting the internal components.

As seen best in FIG. 7, the longer lateral sides 202, 204 may additionally each include formed supporting channels 202*g*, 204*g*, respectively, that are spaced at predetermined intervals along the respective lengths L of each of the sides 202, 204. The channels 202*g*, 204*g* may extend roughly halfway downwardly along the height H2 such that one of the crossbars 214 may be inserted into each channel 202*g*, 204*g*, the crossbars 214 are supported by the sides 202, 204 in respective channel ends forming shelves 216 to remain at position roughly halfway along the height 112, thereby dividing the interior space of the vault 200 into roughly equal spaces that can each contain a coffin C.

The channels 202*g*, 204*g* may be at opposing positions relative to one another when the vault 200 is in the assembled state, as shown in FIG. 7, such that when the crossbars 214 are placed within the channels 202*g*, 204*g*, the crossbars 214 are generally parallel to one another. Respective shelves 216, formed at the end of each channel 204*g*, 202*g* are shaped to receive the end caps 214*a* of each cross bar 214. A shelf cover 216*a* may include supports 216*s* (similar to supports 212*s*) that are spaced at predetermined intervals such that the supports 216*s* are spaced to allow removal of flexible support straps after a coffin C is in position. Additionally, shelf cover 216*a* may include end tabs 216*c*, shaped to fit within the end of each end channel 202*g*, 204*g* on respective shelves 216 to provide a substantial mid-cover over a bottom coffin C (as in FIG. 6) and to accommodate a portion of the end cap 214*a* of each crossbar 214 therein. The shelf 216*a* may support one of the coffins C.

The crossbars 214 each include the end cap 214*a* at opposing sides with respect to the length of the crossbar 214. The end caps 214*a* are formed with a manner to be adjustably and threadably received (by threads 214*b*) onto the ends of each crossbar 214, such that the length of the crossbar 214 (including the endcaps 214*a*) may be adjusted such that when the crossbar 214 is placed within opposing grooves 202*g*, 204*g* of respective sides 202, 204, the endcaps 214*a* may be adjusted inwardly and outwardly to apply greater pressure upon the lateral sides 202, 204 and that during removal of the crossbar 214 (to position a lower coffin or casket C), the endcaps 214*a* may be rotated relative to crossbar 214 to shorten its overall length and to facilitate removal of the crossbar 214 from the grooves 202, 204*g* in which it was placed. It will be recognized that over time, external earth may apply a substantial compression pressure to the outer walls 202, 204 etc., making lifting-removal difficult, so that reducing the length of cross bars 214 while in position (before removal) is essential to aid in their easy removal. The length adjustment may be accomplished in any convenient manner sufficient to meet the needs of the invention and is not limited to the threads 214*b* as shown, but will be recognized as length adjustment mechanisms, including but not limited to wedge-arrangements, channel-groove arrangements, pin-hole arrangements, and others.

Figure 9:
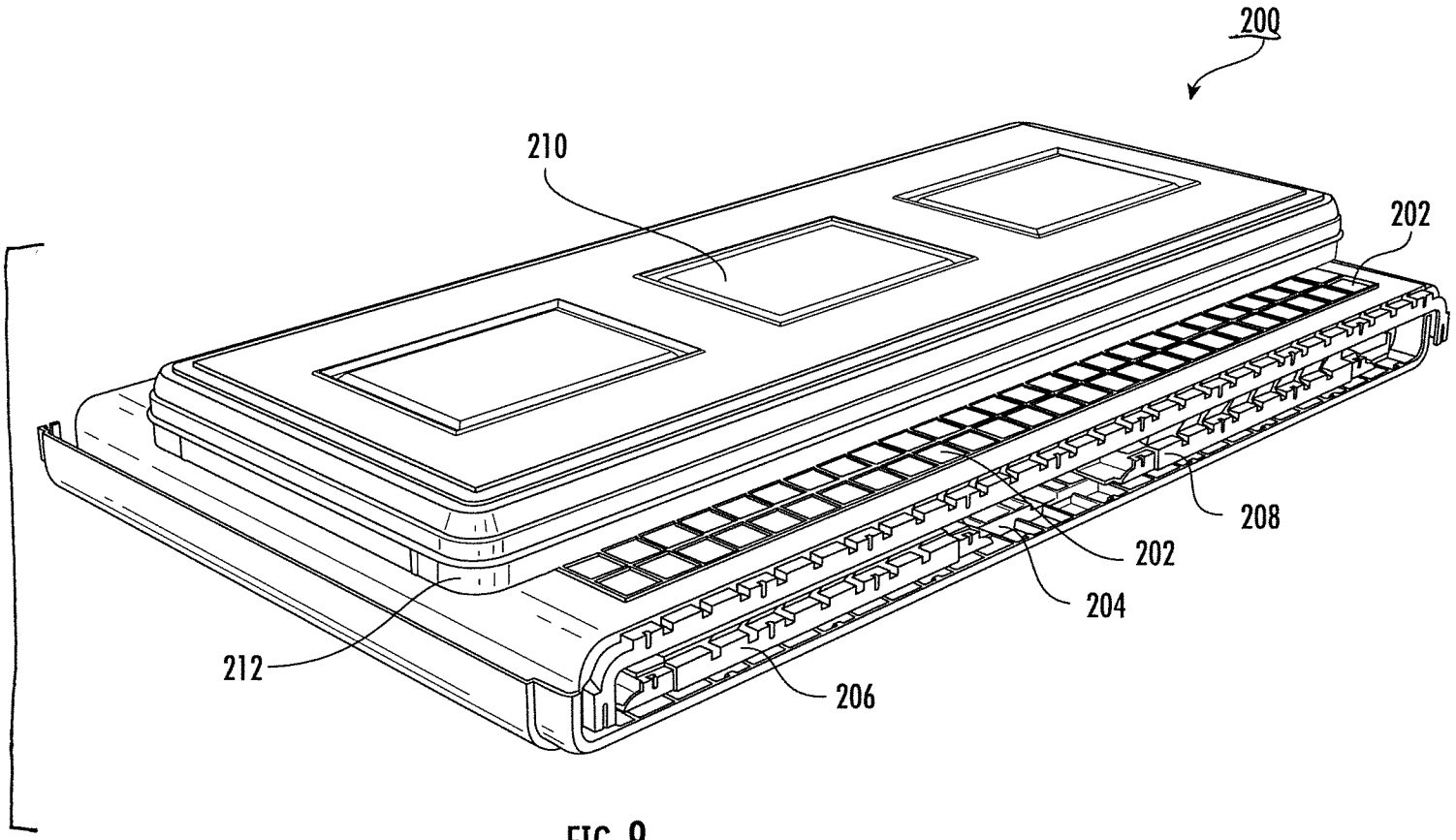
FIG. 9 is a perspective view illustrating the single capacity burial vault of FIG. 5 shown in a collapsed, flat-pack kit form.

Just as with vault 100, as shown in FIG. 9, the components of the vault 200 may be stored in a flat-pack kit form to save space during storage. During use, the vault 200 may be assembled in a similar manner to the vault 100 using a plurality of respective captive fasteners F (not shown) received within a suitable arrangement of holes 206*b*, 208*b* on extensions 206*a*, 208*a*, and grooves 202*b*, 204*b* on respective flanges 202*a*, 204*a* into respective. A first coffin C may be placed within the vault 200 and placed upon the base 212. Crossbars 214 may then be inserted within the channels 202*g*, 204*g*, respectively, end caps 214*a* adjusted to secure length on respective shelves 216 in respective channels 202*g*, 204*g*, and then the shelf cover 216*a* may be placed thereupon. Thereafter, a second coffin C may be placed upon the shelf cover 216*a*. The cover 210 may then be secured to the sides 202, 204, 206, 208 to seal the vault 200.

The burial vaults 100, 200 as discussed herein may be made of any suitable material or mix of materials for the purpose noted herein, including plastic including for example ABS and PVC type plastics, fiberglass, carbon fiber, metal, polymer matrix compositions and otherwise. Similarly, the components such as the cross bars 214 (likely metal, but also reinforced fiberglass, plastics of any type, concrete, etc.), pressure relief valves 300A, 300B, gaskets and fasteners F, can all be made of any suitable material for the purposes as discussed herein.

Glossary of Reference Characters

100: single capacity burial vault
102: lateral wall
102*a*: end surface
102*b*: groove
102*p*: protrusion
104: lateral wall
106: lateral wall
106*a*: lip
106*p*: protrusion
108: lateral wall
108*a*: lip
108*p*: protrusion
110: lid or top cover or wall
110*a*: perimeter
110*c*: channel or groove
112: base or bottom wall
112*a*: perimeter
112*c*: channel or groove
112*s*: grooves for straps
200: double capacity burial vault
202: lateral wall
202*g*: channels
204: lateral wall
204*g*: channels
206: lateral wall
208: lateral wall
210: lid or top cover or wall
212: base or bottom wall
212*s*: grooves for straps
214: lateral support crossbar
214*a*: end cap
216 shelf(s) and shelf cover 216*a*
F: fastener
S: washer
B: bolt
L: length
W: width
H1: first height
H2: second height
C: Casket or coffin
300A, 300B: one-way pressure relief systems Having described at least one of the preferred embodiments of the present inventions with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. A burial vault, comprising:

a first pair of lateral sides;

a second pair of lateral sides;

a base having a length and a width and configured to releasably receive the first pair of lateral sides at opposing ends of the length and configured to releasably receive the second pair of lateral sides at opposing ends of the width;

the second pair of lateral sides each defining an inner surface, the inner surface defining at least one channel extending partially along respective heights of the lateral sides;

a top cover covering a top rim of respective said lateral sides thereby enclosing said burial vault;

during a use a captive fastener system containing a plurality of fasteners each removably extending between extending flanges of respective pairs of side walls of each lateral side and joining respective lateral sides together, and each respective lateral side to said base;

a plurality of stiffening geometries in each respective lateral side minimizing a flexing thereof during said use a plurality of supports on said base spacing a first portion of an inner base surface from a second portion of said inner base surface, whereby during said use said supports facility a position of an external casket in said burial vault;

a plurality of opposed receiving-channels along inner surfaces of at least one pair of lateral sides;

a respective plurality of adjustable crossbars configured to be received within the opposed said respective receiving-channels and configured to span the width of said pair of lateral sides and to resist an external force applied to an exterior surface of the lateral sides; and each said crossbar including at least one end cap adjustably received on an end of the crossbar such that an overall length of each said crossbar is adjustable.

2. The burial vault system, according to claim 1, further comprising:

at least a first one-valve on one of said lateral sides, said base and said top cover, whereby said at least first one-way valves allows a release of one of moisture and an over pressure within said burial vault system.

3. The burial vault system, according to claim 1, further comprising:

a cover covering respective said cross bars following an assembly therewith; and said cover including a plurality of cover supports spacing a first surface of said cover from a second surface of said cover whereby during said use said cover supports facility an easy position of an additional external casket in said burial vault supported by said cover and said cross bars.

4. A method of assembling a burial vault system, comprising:

providing a burial vault, comprising:

a first pair of lateral sides;

a second pair of lateral sides;

a base having a length and a width configured to releasably receive the first pair of lateral sides at opposing ends of the length and configured to releasably receive the second pair of lateral sides at opposing ends of the width;

the second pair of lateral sides each defining an inner surface, the inner surface defining at least one receiving-channel extending partially along respective heights of the lateral sides;

a cover shaped to cover respective lateral sides and said base during said assembly; and providing a captive fastener system containing a plurality of fasteners each removably extending between extending flanges of respective pairs of side walls of each lateral side and joining respective lateral sides together, and each respective lateral side to said base;

assembling respective said base and said respective lateral sides with respective fasteners;

at least one pair of said lateral sides includes a plurality said receiving-channels;

providing a plurality of crossbars configured to be received within the respective said plurality of receiving-channels and configured to span a width therebetween and to brace the lateral sides to resist forces applied to an exterior surface of the pair of lateral sides, each crossbar including at least one end cap threadably received on an end of the crossbar such that an overall length of the crossbar is adjustable;

securing the first pair of lateral sides at opposing ends of the length of the base;

securing the second pair of lateral sides at opposing ends of the width of the base;

securing the plurality of crossbars within opposing ones of the plurality of said receiving-channels of the second pair of lateral sides to span a space between the second pair of lateral sides; and placing said cover over said formed burial vault.

* * * * *